United States Patent [19]

Steinbrecher

[11] 4,267,918

[45] May 19, 1981

[54] PACKAGING MACHINE

[76] Inventor: Bernhard Steinbrecher, Südendstr. 54, 7500 Karlsruhe, Fed. Rep. of Germany

[21] Appl. No.: 43,479

[22] Filed: May 29, 1979

[30] Foreign Application Priority Data

May 29, 1978 [DE] Fed. Rep. of Germany ..... 2823331

[51] Int. Cl.[3] ..... B65G 37/00

[52] U.S. Cl. ..... 198/472; 198/648; 53/252; 141/171

[58] Field of Search ..... 198/472, 580, 409, 412, 198/648, 655, 339, 377, 741, 742; 141/171, 282; 53/252, 564, 565, 251

[56] References Cited

U.S. PATENT DOCUMENTS

| | | | |
|---|---|---|---|
| 3,342,304 | 9/1967 | Greulich | 198/655 |
| 3,407,915 | 10/1968 | Strutz et al. | 198/377 |
| 3,478,859 | 11/1969 | Krempel et al. | 198/741 |
| 3,931,882 | 1/1976 | Ossbahr | 198/648 |

FOREIGN PATENT DOCUMENTS

| | | | |
|---|---|---|---|
| 2253632 | 5/1974 | Fed. Rep. of Germany | 198/472 |

*Primary Examiner*—Joseph E. Valenza

*Attorney, Agent, or Firm*—Laubscher & Laubscher

[57] ABSTRACT

A packaging machine is disclosed including transport elements adapted to receive articles, namely goods to be packed, packaging materials and auxiliaries and/or packages, said transport elements being movable along an endless conveying path past stationary work stations. The work stations act upon the articles in at least two different work directions. At each location where the working direction changes a turn station is provided in order to turn the transport elements in a position in which the articles may suitably be acted upon by said work stations. In a preferred embodiment the transport elements are formed by containers which abut each other by their side portions and are transported by a common push drive means reciprocating stepwise in the conveying direction by an extent each which corresponds to a dimension of the container. Time-consuming work stations which work slower than other work stations may be provided in multiple numbers at a correspondingly multiplied number of parallel conveyor sections. Transfer stations at the transitions from one-lane to multi-lane transport transfer the transport elements to and from the parallel lanes.

3 Claims, 13 Drawing Figures

PACKAGING MACHINE

BRIEF DESCRIPTION OF THE PRIOR ART

The invention relates to a packaging machine with which transport elements adapted to receive articles, namely material to be packed, packing means, packing aids and/or packages, are movable along an endless conveying path past stationary work stations.

In packaging it is often necessary to put goods to be packed, such as small pipes, bottles, trays, blisters, even pouches, bags, tubes, and the like into a package together with enclosures, such as spoons, hollow needles, syringes, leaflets, prescriptions, and other more or less stable packing means and/or packing aids shaped regularly or irregularly.

Furthermore, it is necessary to fill liquid, pasty, and other media of different viscosities, such as ointments, beverages, pastes, and the like into containers of any desired shape, appearance, and rigidity, such as bottles, tubes, canisters, bags, and the like and to process such containers after being filled, such as by signing, addressing, imprinting them, making them ready for shipment in a package, bundling them, or handling them in any other way that may be required for the packing process.

Moreover, it is frequently required in packaging to fill powdery, granular, lumpy, bulk material, able or not able to ripple such as coffee, cocoa, tea, rice, sugar, noodles, oatmeal, and the like into bags, folding boxes with or without interior lining and to put piece goods, such as chocolate candies, tablets, suppositories, and the like into cartons, tubes, or blisters and to process such packages, for instance sign them, provide them with enclosures, imprint them, or prepare the package for orderly reception of the goods to be packed.

It is of advantage, with any of these packing procedures which can be done mechanically, if the package, the material to be packed, the packaging materials and auxiliaries can be handled in horizontal, vertical and/or inclined positions, as selected, at the various work stations required for the packing process. For example, noodles, salt, sugar, and the like will best be poured vertically into a package, and then the package itself, after being closed, often is handled better in horizontal position when being imprinted, signed, or the like. Folding boxes, on the other hand, often are favorably filled in horizontal position with bags, blisters, bottles, small pipes, trays, tubes, and the like, while enclosures, such as spoons, hollow needles, syringes, and the like conveniently are added in vertical position.

Similarly, it is favorable to prepare packages or inserts into packages for systematic reception of goods to be filled, such as chocolates, tablets, and the like in horizontal, vertical or inclined position and to fill or process them otherwise in a tilted position with respect to the first position, e.g. in vertical position.

Normally, packaging machines operate horizontally or vertically. In any one machine the articles thus are handled only horizontally or only vertically or only in oblique position. If the packaging process in the course of the further packing requires handling in another position, this is done separately in a second machine to which the articles are supplied after a manual or mechanical turning procedure.

In a cartoning machine, for instance, bottles, small pipes, and tubes normally are pushed horizontally into a folding box. If a dosing spoon, hollow needle, or the like is to be enclosed, this generally causes considerable technical difficulties.

SUMMARY OF THE INVENTION

It is the object of the invention to enable the complete packing of articles of the most varied shapes and consistencies in simple manner in a single packaging machine of the kind defined initially, permitting successive handling of each package in horizontal, vertical, and/or oblique positions.

To meet this object, it is provided, in accordance with the invention, that work stations acting in at least two different directions are provided and designed to act upon articles of any desired shape and nature, and that at least at two locations of the endless conveying path, where the working direction changes, a turn station each, i.e. a total of at least two turn stations are provided.

With the packaging machine according to the invention it is possible to subject packages, material to be packed, packaging materials, and auxiliaries to the packing process selectively in horizontal, vertical, or oblique positions. Any desired material to the packed can be packed by a single machine, and only the transport element and the work stations must be adapted to the material to be packed and the packing process, whereas the packaging machine itself comprises a system of a combination according to the respective packing process of work stations of the kind of modules operating in vertical, horizontal and/or inclined positions and at least two turn stations. The work stations may be of such character that their basic structure is adapted to the handling of packages, material to be packed, packing means, and packing aids of any desired kind and shape.

The work stations may be combined in any desired order to form a system in accordance with the requirements of the packing process. As the conveying path is endless, the only factor to be taken into consideration is that the transport elements in the end must return to their starting position.

With the packaging machine according to the invention only the individual tools at the work stations and the transport elements must be adapted to the specific character of the articles to be handled. This adaptation is made in an especially simple manner as regards the transport elements which have inserts adapted in shape to the articles and which may be adjustable so as to permit adaptation to different formats.

Preferably, the transport elements are moved along a conveying path between two turn stations by means of a common push drive means which may be designed, for example, as a feed beam or the like.

Transfer stations of which a multiple number may be provided permit a multi-lane design comprising a plurality of parallel conveyor sections. Time consuming work stations are arranged in multiple number along such parallel conveyor sections. The drive for these parallel conveyor sections may be derived mechanically from the push drive means, thus providing for a very simple design.

Optimum adaptation to the specific technology of a packing process may be obtained readily, without changing the speed of a work cycle, by selecting different partial speeds for displacement, transfer, and turning.

BRIEF DESCRIPTION OF THE DRAWINGS

The invention will be described further, by way of examples, with reference to the accompanying drawings, in which:

FIGS. 1*a*, 1*b* to 4*a*, 4*b* show four characteristic conditions in a work cycle of a packaging machine according to the invention, letter "a" indicating a front view and letter "b" a side elevation;

DETAILED DESCRIPTION

Figure 1A:
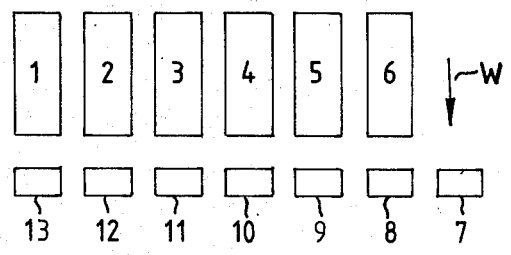

FIGS. 1*a* to 4*b* merely show transport elements in instantaneous rest positions at work stations not shown in the drawing or at turn stations, respectively.

In FIGS. 1*a* to 4*a* the transport elements 1 to 6 are shown in vertical position (elongated rectangles) and the transport elements 7 to 12 in horizontal position (short rectangles).

Figure 1B:
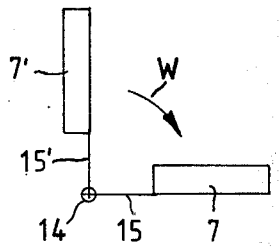

During the work step shown in FIGS. 1*a* and 1*b* a transport element 7 is moved from a vertical position 7' into horizontal position shown in FIG. 1*a* by means of a turn station as indicated by the arrow w. The turn station is shown in FIG. 1*b* to be a turning plate 15 which is pivotal about a fulcrum 14 and has two limit positions which differ from each other by 90°. During the turning the respective work stations carry out their work on the contents of the transport elements 1 to 8 and 8 to 13.

Figure 2A:
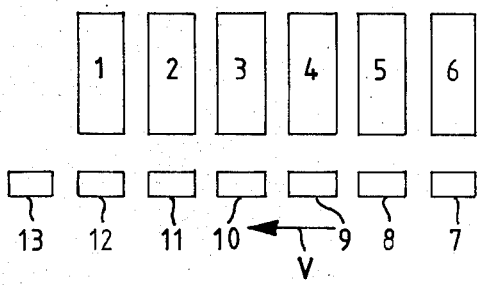
Figure 2B:
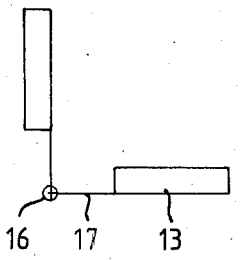
Figure 3A:
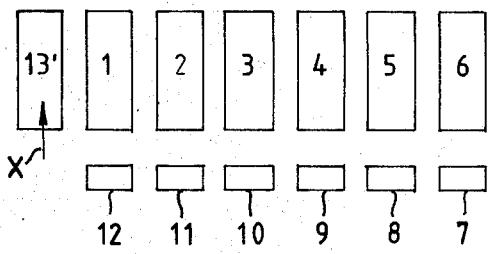
Figure 3B:
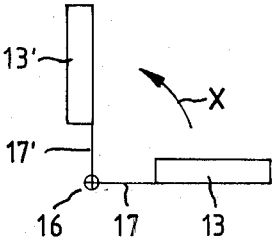

During the subsequent work step shown in FIGS. 2*a* and 2*b* the transport elements 7 to 13 are pushed on by one step up to the next work station, as indicated by the arrow v. Hereby transport element 13 is moved to a turn station located at the left end of the two parallel conveyor sections and indicated in FIG. 2*b* as a turning plate 17 which is pivotal about a fulcrum 16.

During this displacement the work stations 1 to 6 may continue their work.

Turning plate 15 returns to its starting position 15'. During the third work step according to FIGS. 3*a* and 3*b* at the same time the transport element 13 may be turned from the horizontal position shown in FIG. 2*a* into the vertical position 13' shown in FIG. 3*a* (see also 3*b*). This turning process is effected in the opposite turning direction to the one shown in FIG. 1 and is indicated by letter x. During the work step shown in FIGS. 3*a* and 3*b* work may continue on transport elements 1 to 6, and a new treatment process may be started on transport elements 7 to 12 upon displacement to their new work stations.

Figure 4A:
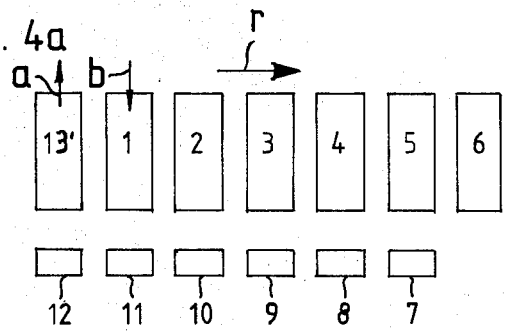
Figure 4B:
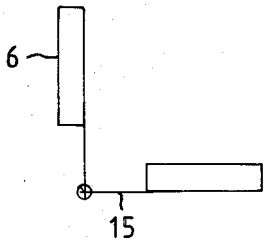

FIGS. 4*a* and 4*b*, finally, show a work step at which the transport elements 1 to 6 and 13 are displaced to the next work station in the direction of arrow r in opposite sense to the direction of movement shown in FIG. 2 (arrow v). The transport element which is positioned farthest to the right will thus reach the turn station 14, 15 and is now ready for a new turning process according to FIG. 1 which again may be carried out in synchronism with the return pivot movement of the turning plate from position 17' to the starting position 17. It is obvious that the article which has been finished in the packing machine may be removed at a certain location of the cycle, e.g. at the position indicated by arrow "a" in FIG. 4*a*. Also, the transport element may be loaded with new articles as yet untreated at the same position or at one station farther to the right, as seen in the FIGS. and indicated in FIG. 4*a* by arrow "b".

Analogous to the possibility of joint turning according to FIGS. 1*a*, *b* and 3*a*, *b* during standstill in the displacement cycle acccording to FIGS. 2*a*, *b*, and 4*a*, *b* is another possibility, namely that of common displacement according to FIGS. 2*a*, *b*, and 4*a*, *b* by pushing means which act in opposite directions and are fed by a common drive means at standstill of the turning plates. An embodiment of the packaging machine will now be described with reference to FIGS. 5 to 7.

In these FIGS. reference numeral 50 designates transport elements in the form of containers. Each container is open at two opposed sides and at the top and limited in the direction of conveyance by opposed sidewalls 51, 52. At least one of the sidewalls 51, 52 is displaceable thus making the distance between the sidewalls 51, 52 adjustable for the reception of packages or material to be packed of different sizes. A longitudinal slot 53 having undercuts 55 formed by claws 54 extends under the container 50 in the direction of conveyance. A slide rail 56 fits into the undercuts. This slide rail 56 which is mounted on a frame 57 constitutes a horizontal conveyor section for the containers 50. Each container includes a locking projection 58 in which a hole 59 is formed which may receive a locking bolt (not shown) to check movement at the respective work station. The total length 1 of the container determines the length by which the container is advanced at each work step. This is effected by a push drive means movable in direction of arrow C in and out of contact with the containers and embodied by a feed beam 60 grasping all the containers of the conveyor section between two flanges 61, 62 which protrude from its ends and displacing the containers in each instance by the length 1 in the area between turn stations 63, 64 disposed at the left and right ends, respectively. The turn stations 63, 64 are interconnected by a rotary shaft 67 so that the pivot movement can be introduced by way of a common shaft. They are each provided with a turning plate 65 which has the same profile as the slide rail 56 so that the turning plate fits into the undercut slot 53 of the holders 50. The turning plate 65 is carried by a rocking lever 66 which can be swung about the horizontal rotary shaft 67 into a vertical position in the direction of arrow x in FIG. 5 to a second or "vertical" conveyor section along which the holders 50 are displaceable, in a position rotated through 90°, on a slide rail 68 carried by a frame 69. The slide rail 68 also has a profile which fits into the untercut slot 53 of each holder. Also the second conveyor section is provided with a feed beam 70 corresponding to feed beam 60 and being of the same design and having the same mode of operation as the feed beam 60. A container element 71 for packages which are carried along by the container and which are now oriented vertically in the second conveyor section is mounted on the frame 69 in addition to the slide rail 68. The guide slots and undercuts may also be provided inversely for the containers and the slide rails. Along both conveyor sections work stations are provided at mutual spacings which correspond to the lengths 1 of the holders. It is also possible to provide empty stations. At the horizontal conveyor section a magazine 80 for folding carton 81 is shown as an example. At the corresponding location above the respective container 50' (FIG. 7) a suction device 49 picks up a folding carton out of the magazine, and the carton is then erected into the position 81' shown in FIGS. 6 and 7. After a work step in the direction of arrow v, i.e. one work station farther to the left from magazine 80 an article, such as a tube, an inner lining or the like is pushed from the side into the folding carton by means of a ram 90.

Further working processes follow at successive work stations to the left upon a displacement each by the length of a container in the direction of arrow v.

Figure 5:
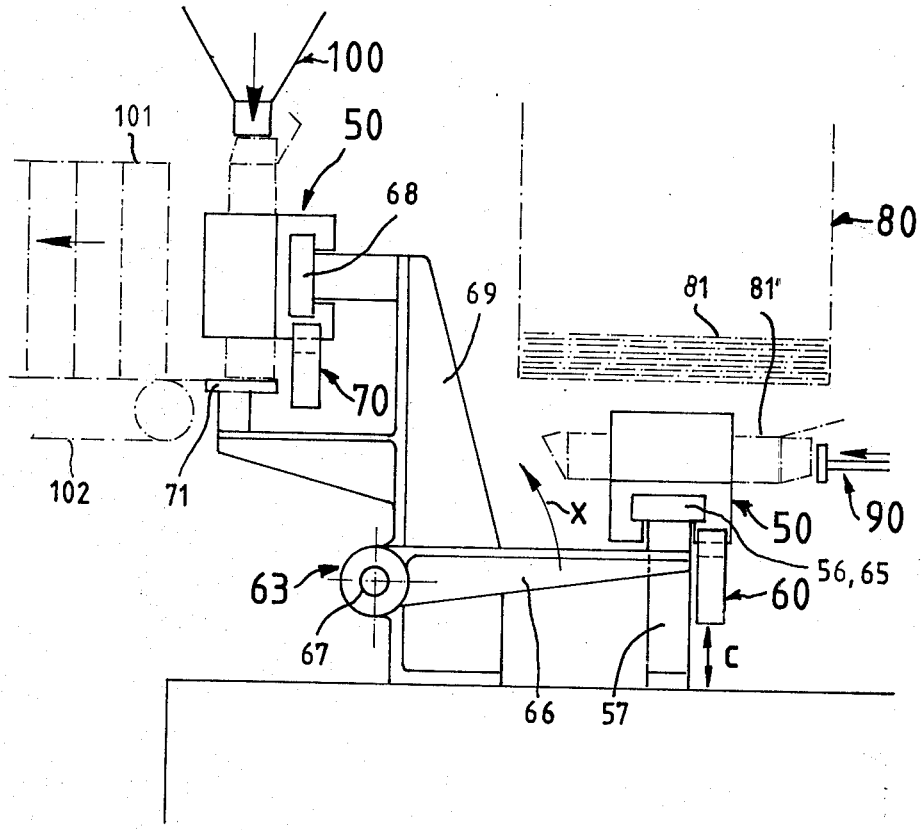
FIG. 5 is a side elevation of a packaging machine according to one embodiment.
Figure 6:
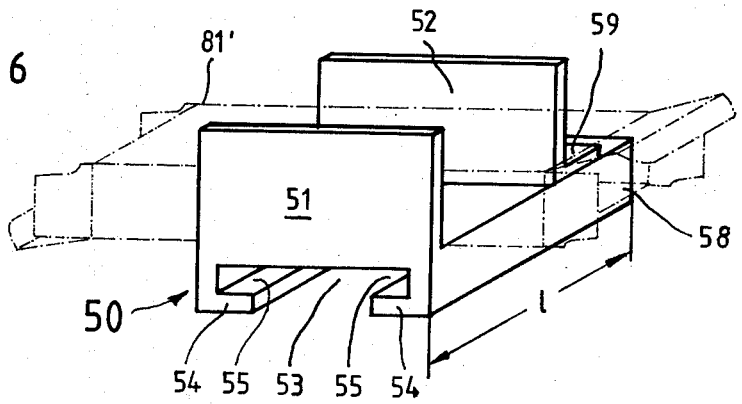
FIG. 6 is a perspective view of a transport element of the packaging machine shown in FIG. 5.
Figure 7:
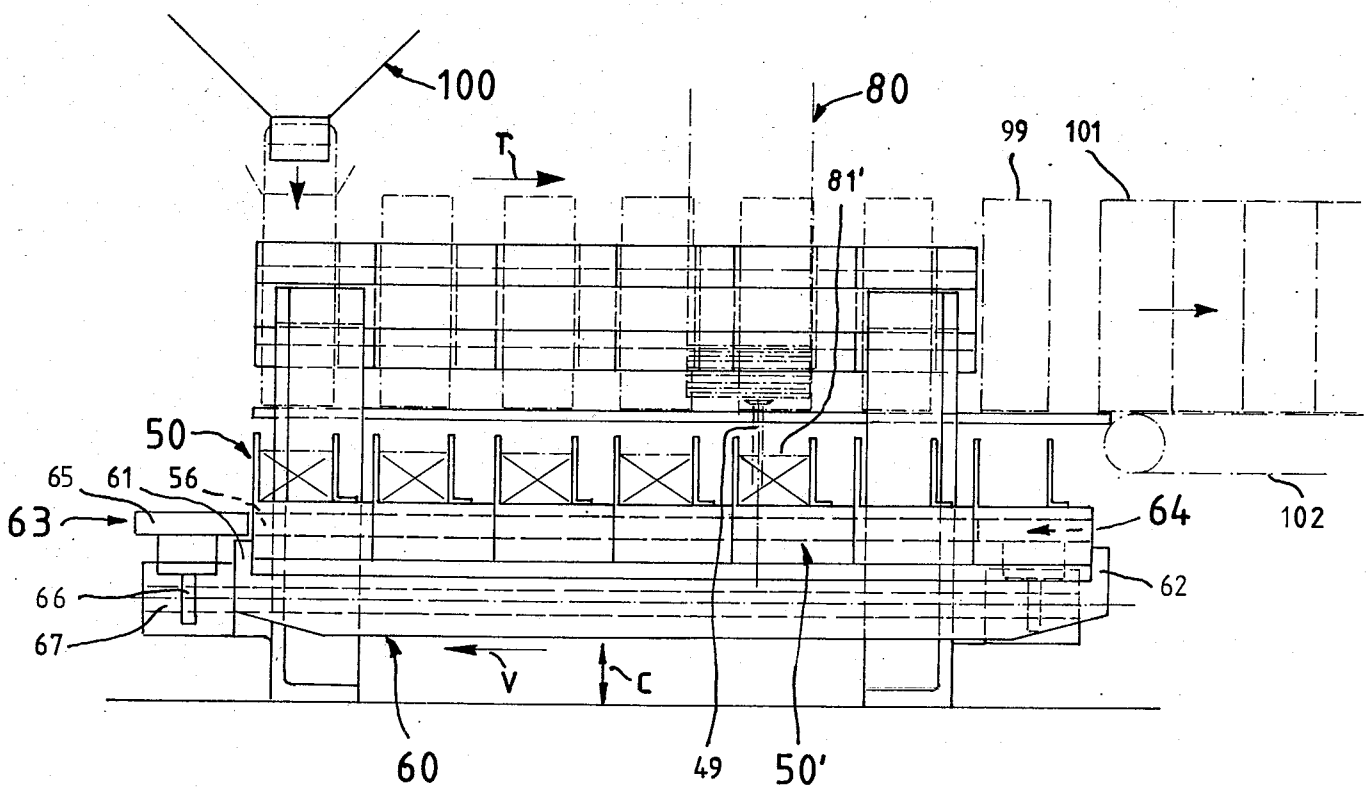
FIG. 7 is a front view of the packaging machine according to FIG. 5.

At turn station 63 the respective container 50 with its folding carton is moved into vertical position and moved from the turn station to the first vertical work station upon displacement in the direction of arrow r (opposite direction to arrow v). In the example shown, a hopper 100 through which material to be packed is filled is positioned at this first vertical work station. Further work steps preferably to be carried out in vertical position will follow at successive work stations in the direction of arrow r until the finished package designated 101 in the embodiments shown in transferred to a discharge conveyor 102 which is shown in FIG. 5 to move at right angles to and in FIG. 7 in the direction of the vertical conveyor path. In its position above the right turn station 64, as shown in FIG. 7, the package is designated 99. In this position the container which is positioned farthest to the right in the vertical conveyor section (FIG. 7) is taken over by the turn station 64 and moved back on to the slide rail 56 of the horizontal conveyor section so that at this location the package is removed from the endless conveyor path along which the containers are moved in steps.

As already mentioned, the sidewalls 51, 52 of the holder may be adjustable with respect to each other so as to permit adaptation to packages of different sizes. For further improvement of this adaptation inserts with correspondingly shaped cavities can also be mounted in the containers. This will make it possible to adapt them to irregular packages which cannot easily be brought into or clamped in a stable position of the like.

It is evident that each of the horizontal, vertical, and/or oblique conveyor sections may also be designed to have several parallel conveyor sections over part or all of their length. In this case the "switch" at the transition from single to multi-lane design is provided by at least one transfer device. This alternative can be selected if certain work operations require more time than other work operations for which those work stations which are more time consuming are multiplied in accordance with the number of the plurality of conveyor sections. In an advantageous and particularly simple manner the drive for the parallel conveyor sections may be derived mechanically directly from the feed beam described above. The transfer is effected by a plate of exactly the same design as the turning plate 65. In this instance it is connected with a push drive means instead of a turning drive means 66, 67. Apart from the respective drive means the multi-lane design of the invention thus makes it possible to use the same parts at the transfer station and at the turning station.

In just as advantageous and simple manner multiple transfer stations may derive their drive from a common drive means.

Figure 8A:
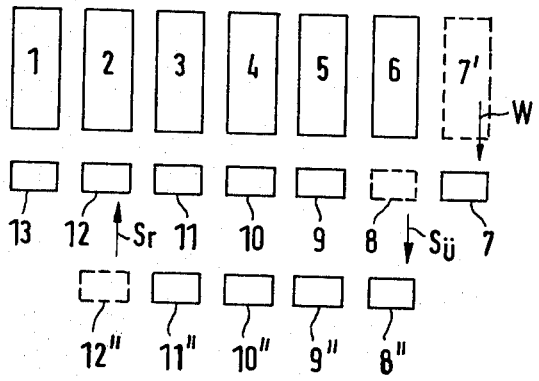
FIGS. 8*a* and 8*b* a condition corresponding to the condition of FIGS. 1*a* and 1*b* in a work cycle of a two-lane packaging machine in front and side view, respectively.
Figure 8B:
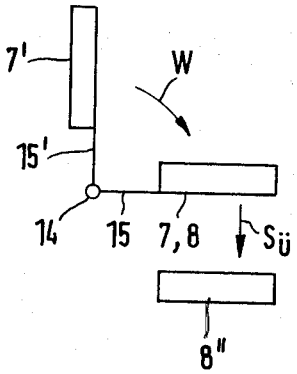

In FIGS. 8*a*, 8*b* the transition from single-to multi-lane transport by means of transfer stations is shown diagrammatically, the transport elements 1 to 6 being in vertical position and the transport elements 7 to 13 for a first horizontal path and 8'' to 11'' for a second horizontal path offset parallel to the first one being in horizontal position, in analogy to FIGS. 1*a*, 1*b*. The work step according to FIGS. 8*a* and 8*b*, on the one hand, shows the turning of the transport elements, already described with reference to FIGS. 1*a* and 1*b*, from the vertical position 7' into the horizontal position 7 and, on the other hand, the simultaneously effected transfer in direction of arrow $S_{ü}$ of a horizontally disposed transport element 8 into the offset prallel position 8'' of a second horizontal path offset in parallel to the first horizontal path, as well as the re-transfer in direction of arrow $S_r$ of a transport element 12'' from the offset path into the original path and position 12. The machine effects double-lane operation in the range of stations 9 and 9'', 10 and 10'', and 11 and 11'', respectively. At stations 8 and 12 the transfer is made to 8'' and 12'', respectively.

Within the limits of the double-lane section the machine transports and operates at half the speed of the single-lane sections and as compared to the transfer and turning. In general, in multi-lane machine sections the work speed is lower by the ratio of the number of lanes, e.g. 1:2, 1:3, 1:4, etc. in case of two, three, four lanes etc.

In analogous manner the phases of movement characterized by FIGS. 2*a*, 2*b* to 4*a*, 4*b* for the single-lane packaging machine also result for the multi-lane packing machine; they are not shown here.

The multi-lane design is shown only in the horizontal plane. It is obvious, however, that instead of one horizontal and one vertical conveyor section only, the endless conveyor path may also comprise a plurality of horizontal and vertical and oblique sections. These conveyor sections are arranged successively and linked to each other by a turn station and a transfer station each, at least one work station being disposed at each of these conveyor sections.

What we claim is:

1. In a packaging machine of the type including transport elements adapted to receive articles of a desired shape and nature, said transport elements being movable by endless conveyor means past stationary work stations adapted to act in at least two different directions of work upon the articles, the improvement wherein (a) said conveying means comprises at least two separate conveying portions each including guiding means for guiding transport elements (50) along said conveying portions, the number of said separate conveying portions corresponding to the number of different working directions, (1) said separate conveying portions being arranged in planes that intersect at an angle corresponding with the angle between the different working directions:

(2) said transport elements and said guide means including cooperating undercut guide slot (53) and rail means (56, 68) for retaining the elements in a given orientation in each conveying portion;

(b) wherein at the end of each conveying portion turning means (63, 64) are provided for transposing the transport elements from the preceding to the following conveying portion, each of said turning means including a rocking lever (66) pivotally connected at one end for pivotal displacement about an axis (67) parallel with said guide rail means, and a turning plate (65) connected with the free end of said rocking lever, said rocking lever being pivotable between first and second transfer positions in which said turning plate is aligned with the guide rail means of said separate conveying portions, respectively, thereby to transport an element from one guide means to a position opposite one end of the other guide means; and (c) further wherein each conveying portion includes drive means (60,70) for driving the transport elements in common along each conveying portion.

2. A packaging machine as defined in claim 1, and further including vertically and horizontally acting work stations, said transport elements comprising containers which are open at the sides and at the top, said containers having sidewalls extending transversely of the direction of conveyance.

3. A packaging machine as defined in claim 1, wherein adjacent transport elements have abutting side portions, and further wherein each row of transport elements is disposed between two turn stations and is driven by common push drive means operable to reciprocate stepwise in the conveying direction by an extent corresponding to the dimension of a container.

* * * * *